US007132940B2

(12) United States Patent
Ehben et al.

(10) Patent No.: US 7,132,940 B2
(45) Date of Patent: Nov. 7, 2006

(54) WARNING SYSTEM AND METHOD FOR MONITORING THE AVAILABILITY OF MEDICAL AIDS FOR A PATIENT

(75) Inventors: Thomas Ehben, Weisendorf (DE); Michael Mankopf, Möhrendorf (DE)

(73) Assignee: Siemens Aktiengesellschaft, Munich (DE)

( * ) Notice: Subject to any disclaimer, the term of this patent is extended or adjusted under 35 U.S.C. 154(b) by 122 days.

(21) Appl. No.: 10/930,120

(22) Filed: Aug. 31, 2004

(65) Prior Publication Data

US 2005/0057356 A1 Mar. 17, 2005

(51) Int. Cl.
*G08B 1/08* (2006.01)

(52) U.S. Cl. ..... 340/539.21; 340/539.1; 340/573.1; 340/686.6; 340/612

(58) Field of Classification Search ..... 340/573.1, 340/573.4, 539.1, 539.21, 539.23, 686, 309.16, 340/612–7, 825, 686.6; 128/898
See application file for complete search history.

(56) References Cited

U.S. PATENT DOCUMENTS 4,617,557 A 10/1986 Gordon
5,841,352 A * 11/1998 Prakash ..... 340/573.4
5,864,642 A * 1/1999 Chun et al. ..... 385/14
5,950,632 A * 9/1999 Reber et al. ..... 128/898
6,472,986 B1 10/2002 Sorriaux
2002/0097156 A1 7/2002 Broas
2002/0126012 A1* 9/2002 Page ..... 340/571
2003/0063524 A1 4/2003 Niemiec et al.

FOREIGN PATENT DOCUMENTS

DE 9302034 U1 8/1993

OTHER PUBLICATIONS

European Search Report.

* cited by examiner

*Primary Examiner*—Jeffery Hofsass
*Assistant Examiner*—Hongmin Fan
(74) *Attorney, Agent, or Firm*—Alexander J. Burke

(57) ABSTRACT

A method and system for monitoring the availability of medical aids for a patient. A first signal transmitter is mounted on the aid for transmitting first electromagnetic signals. A second signal transmitter is worn by the patient and has a warning device for outputting a warning signal which can be perceived by the patient. A receiving unit receives the first electromagnetic signals transmitted by the transmission unit. A control unit actuates the warning device to output the warning signal when the first electromagnetic signal is received and when a predetermined reception strength for the first electromagnetic signal is undershot and when a particular item of information associated with an operative state of the medical aid is transmitted with the first electromagnetic is received.

25 Claims, 1 Drawing Sheet

WARNING SYSTEM AND METHOD FOR MONITORING THE AVAILABILITY OF MEDICAL AIDS FOR A PATIENT

DESCRIPTION

The present invention relates to a warning system and a method for monitoring the availability of medical aids for a patient, particularly for monitoring the availability of important medicaments.

Numerous people are dependent on medical aids, such as medicaments or medical devices, on account of an illness, dysfunction or disablement. In everyday life, it is very important for these people to be able to obtain the medical aids in a short time. One example is emergency medicaments for patients who suffer from asthma or angina pectoris. If these emergency medicaments are mislaid by the patients, are lost or, when needed, are not ready to operate or have been used up, the patients in question may experience life-threatening acute states of health. Normally, the patients themselves are responsible for the availability and the regular state of the medicaments. Particularly in everyday life, however, the patients may not always have full control over the availability of their medicaments, for example on account of outside diversion. This also applies in the same way to the time at which medicaments which need to be taken at firmly prescribed intervals of time are taken. The inventors are currently not aware of any prior art which provides the patient with a reliable aid to avoiding the above problems.

The object of the present invention is therefore to specify a system and a method which automatically draw a patient's attention to when medical aids which are important to him are no longer directly available and/or need to be used.

The object is achieved by the warning system and the method in line with patent claims 1 and 15. Advantageous configurations of the warning system and of the method are the subject matter of the subclaims or can be found in the description below and in the exemplary embodiments.

The present warning system for monitoring the availability of medical aids for a patient, particularly of medicaments, comprises a first signal transmitter on the aid and a second signal transmitter on the patient. The first and second signal transmitters are also capable of receiving electromagnetic signals, and thus function as first and second signal transceivers, respectively. The first signal transmitter can be mounted on the medical aid or on a container for the aid or can be integrated in the aid or the container. By way of example, this first signal transmitter can thus be integrated in the packaging for a medicament as medical aid. The first signal transmitter has a transmission unit for transmitting first electromagnetic signals, and the second signal transmitter has a corresponding reception unit for receiving the first electromagnetic signals transmitted by the transmission unit in the first signal transmitter. In addition, the patient's second signal transmitter comprises a warning device for outputting a warning signal which can be perceived by the patient, and a control unit for actuating the warning device. The second, patient's signal transmitter may be worn by the patient, for example in the form of a finger ring, on a bracelet or on a necklace. It may also be integrated in practical items or items of jewelry, such as wristwatches or charms. The task of the patient's signal transmitter is to warn the patient when necessary by means of the perceptible warning signal, for example a visual alarm, an audible alarm, a vibration alarm or a combination of two or all of these types of alarms. Appropriate configurations of the warning device are known to the person skilled in the art from the prior art. The control unit in the patient's second signal transmitter is in a form such that, when the first electromagnetic signals are received or when a prescribable reception strength for the first electromagnetic signals is undershot and/or when a particular item of information transmitted with the first electromagnetic signals is received, it actuates the warning device to output the warning signal.

The use of this warning system and of the corresponding method draws the patient's attention, depending on the configuration of the system, to the fact that the medical aid which is important to him, for example an emergency medicament or a medical device which is occasionally needed urgently on a spontaneous basis, is no longer within a particular reach and/or is not in a regular, i.e. usable, state. Alternatively or in addition, the warning signal may also be used to draw the patient's attention to the fact that he needs to use the medical aid soon.

In one advantageous configuration of the present warning system and of the associated method, the aid's first signal transmitter also has one or more sensors which detect a state of the aid which is fundamental to use, for example the filling level of a medicament container or the vapor pressure in a spray bottle or pressurized bottle. Another example is sensors for emptied blister packs for medicaments. In this case, the first signal transmitter additionally has a control unit for actuating the transmission unit which, when an irregular state of the aid is identified, for example when a minimal filling level or vapor pressure is detected, actuates the transmission unit either to transmit an electromagnetic signal or a particular signal sequence or to transmit the detected state of the aid in a response signal which is regularly requested by the patient's signal transmitter.

Depending on the configuration of the warning system or of the method, the signal transmission between the patient's second signal transmitter and the aid's first signal transmitter may take place in different ways, it naturally also being possible to combine the configurations indicated below with one another.

Thus, in a first configuration, the aid's first signal transmitter can transmit an electromagnetic signal to the patient's second signal transmitter at regular intervals. If it does not reach the patient's signal transmitter, for example because the aid is too far away from the patient, then the patient's second signal transmitter triggers the warning signal, since the reception strength has fallen below a prescribable threshold value. In this configuration, the patient's attention is thus easily drawn to when he unconsciously moves too far away from the medical aid which is important to him, such as an emergency medicament.

In a second configuration, the patient's second signal transmitter transmits an interrogation signal to the aid's first signal transmitter at regular intervals. The first signal transmitter returns a response signal when it receives this interrogation signal. If this response signal does not reach the patient's second signal transmitter, then a warning signal is produced in the same way as in the first configuration. In a development of this second configuration, in which the state of the medical aid is detected by means of sensors, the response signal may also contain information about this state of the aid. In this case, the information is identified by the control unit in the patient's second signal transmitter, and a warning signal is likewise triggered if the aid is not in a regular state. This configuration thus provides the patient with the further advantage that he is informed about an irregular state of his aid in good time, which means that he can take appropriate measures.

In a third configuration, the aid's first signal transmitter transmits a signal to the patient's second signal transmitter as soon as the sensors detect an irregular state of the aid. The control unit in the patient's second signal transmitter triggers a warning signal on the basis of this received signal. In a development or alternative configuration, the aid's signal transmitter also transmits a signal to the patient's signal transmitter when a firmly prescribed interval for taking or using the aid is not observed by the patient. The observing of this interval can be checked using the sensors, which can detect the use of the aid using an appropriate state change. In this way, the patient is reliably reminded if he does not observe the prescribed interval of time, which is normally a necessity.

In a further configuration of the present warning system and of the associated method, the patient's attention may also be drawn by means of a warning signal to the fact that the end of the life of a medicament, as a medical aid, has been reached or is immediately imminent as soon as this happens. For example, either the patient's signal transmitter or the aid's signal transmitter may contain a time comparison device which compares a programmed comparison time, for example the use-by date, linked to the aid with the respective present time. This naturally also requires an appropriate internal clock, which may also be a radio clock. The comparison time can be set, by way of example, by the patient when breaking open a new pack unit of a medicament, or by the distributor of the medicament or can be firmly programmed into the aid's signal transmitter when the medicament is actually manufactured, if this signal transmitter is mounted on the medicament's pack or in its pack when the medicament is actually manufactured.

The two signal transmitters can be supplied with power by means of batteries. The fact that the transmission of signals is not continual means that the power consumption is low. It goes without saying that solutions are also possible in which, by way of example, the medicament's signal transmitter obtains its power from the patient's signal transmitter or from the ambient noise by means of respective electromagnetic waves. Such techniques are known from the field of wireless information transmission and also from RF-ID (Radio-Frequency Identification) tag technology.

In one development of the present warning system and of the associated method, in addition to alerting the patient using the patient's signal transmitter, it is also possible to transmit a warning message to other people, for example to a carer or a treating physician. To this end, the patient's signal transmitter or the aid's signal transmitter has an interface to an external reception unit which can be used to transmit the warning message to the appropriate other person when a warning signal arises. Thus, by way of example, a connection may be set up to a mobile radio network in order to activate a mobile telephone belonging to the other person, for example in order to draw his attention to the medical aid's fault status. The use of other wireless transmission techniques as a result of the integrated interface being in an appropriate form is naturally also possible, such as a direct wireless short-haul connection directly to a mobile telephone, for example using Bluetooth. Such communication may also be used for automatically requesting a new prescription or a new pack of a medicament if said medicament is no longer in a regular state or has been used up. In addition, when using such an integrated interface, it is also possible to inform a treating physician or other care people if the patient is not taking his medication on a regular basis. Finally, it is also possible to alert care people using the Internet, in which case the patient's signal transmitter then transmits a corresponding item of information to a public mobile radio network directly or using, a mobile telephone which is close by.

The present warning system and the associated method are explained again below using exemplary embodiments in conjunction with the drawings, in which.

Figure 1:
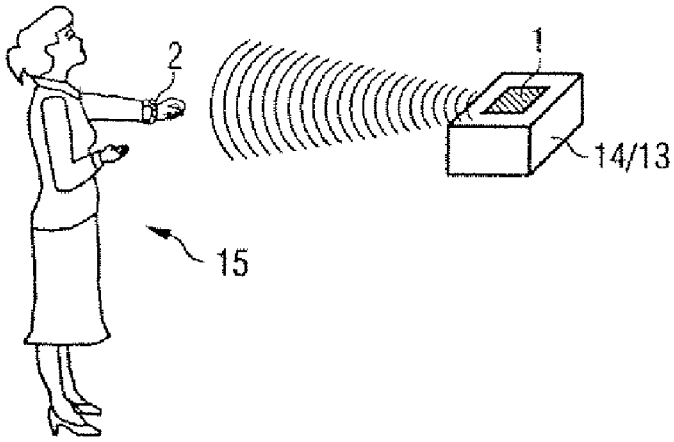
FIG. 1 shows an illustration of the use of the present warning system.

When the present warning system is being used, the patient 15 wears the second signal transmitter 2 constantly on his body, for example integrated in a wristwatch, as illustrated in FIG. 1. In this example, the patient 15 is reliant on an important medicament which is packaged in a container 14. The aid's signal transmitter 1 is also mounted in this container 14 and transmits electromagnetic signals at regular intervals. When the medicament is in the relatively close surroundings of the patient 15, the patient's signal transmitter 2 receives the electromagnetic signals at sufficient reception strength. If the patient 15 forgets his medicament, for example in his apartment, and leaves the apartment, then the patient's signal transmitter 2 outputs a warning signal when a particular range is exceeded, since the received signal has then dropped below a threshold value. The patient 15 can then return and take the medicament with him. This makes it possible to prevent the patient from inadvertently getting into a situation in which he cannot access his medicament if required.

Figure 2:
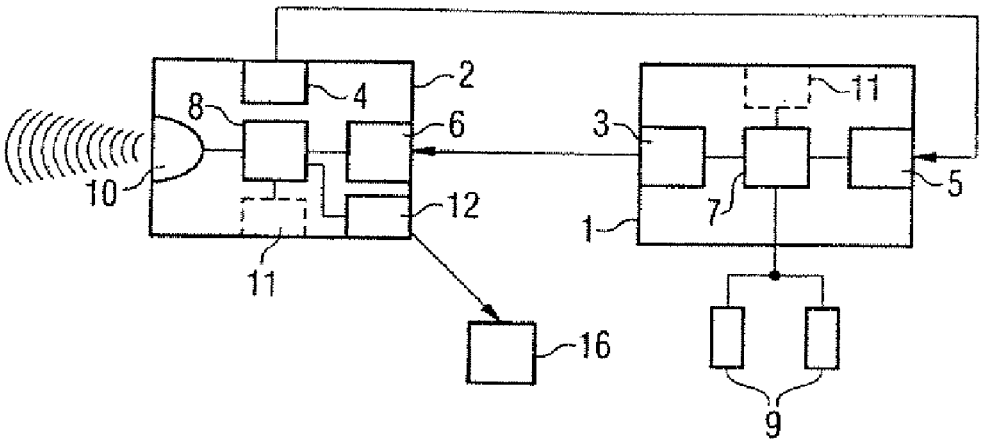
FIG. 2 shows a schematic illustration of components of the present warning system in one possible configuration.

FIG. 2 shows a schematic illustration of individual components of the present warning system in one possible configuration. The left-hand side of the figure shows the patient's signal transmitter 2, which has a reception device 6 and a warning device 10, which are both connected to a control unit 8. The aid's signal transmitter 1, shown on the right-hand side, comprises a transmission device 3 for transmitting electromagnetic signals to the reception device 6 in the patient's signal transmitter 2, as indicated by the arrow. These components are sufficient to ensure that the warning system works in the manner explained in connection with FIG. 1. In this context, the control unit 8 in the patient's signal transmitter 2 checks the reception strength of the received signal. If a prescribable threshold value is undershot, the warning device 10 is actuated to output a warning signal.

In further forms of the present warning system, the aid's signal transmitter 1 also comprises a control unit 7, which actuates the transmission unit 3 to output an electromagnetic signal when required. By way of example, this control unit 7 may be connected to one or more sensors 9 which detect the state of the aid. If an irregular state is detected, the control unit 7 can then actuate the transmission unit 3 to output one or more electromagnetic signals, and when these are received by the reception unit 6 in the patient's signal transmitter 2, the control unit 8 likewise prompts a warning signal.

In addition, the patient's signal transmitter 2 may have a transmission unit 4 and the aid's signal transmitter 1 may have a reception unit 5. In such a configuration, the patient's signal transmitter 2 can transmit electromagnetic signals at regular intervals in order to interrogate the aid's signal transmitter 1. When such interrogation signals are received by the reception unit 5, the control unit 7 in the aid's signal transmitter 1 prompts the transmission unit 3 to output a corresponding response signal. If the patient's signal transmitter 2 does not receive any such response signal to an interrogation signal, a warning signal is triggered. In addition, the control unit 7 may also incorporate information about the state of the aid detected by means of the sensors 9 into the response signal. In this case, the information is evaluated by the control unit 8 in the patient's signal transmitter 2 and a warning signal is likewise triggered if the aid is in an irregular state.

FIG. 2 also indicates, in dashes, the time comparison device 11 explained in the description above, this device being able to be arranged either in the patient's signal transmitter 2 or in the aid's signal transmitter 1. This time comparison device 11 is used for producing a warning signal when the use-by date for a medicament, as the medical aid, is reached.

FIG. 2 also shows the interface 12 for a wireless connection to an external reception station 16 which can be used to transmit a warning message, for example to the mobile telephone of a care person. In the case of a medicament as the medical aid, the check on the stock of medicaments using the sensor or sensors 9 in conjunction with the output of a warning message via the interface 12 also allows automatic requesting of a follow-up prescription or the reordering of a medication, which avoids any interruption in the medication and allows administrative costs to be saved.

Figure 3A:
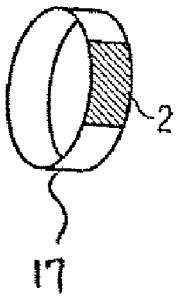
FIG. 3 shows examples of integration or mounting of the signal transmitters in different articles.
Figure 3B:
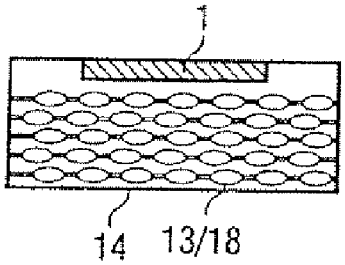
Figure 3C:
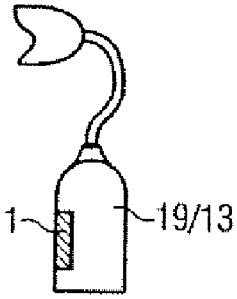

The patient's signal transmitter 2 is preferably miniaturized such that it can be worn on the body as a ring 17 or other piece of jewelry, as indicated in FIG. 3*a*. The aid's signal transmitter 1 can be integrated, by way of example, in a container 14 for medicaments or can be mounted in this container 14 or can be integrated directly in the medical aid 13 or mounted thereon. Both options are illustrated in FIGS. 3*b* and 3*c*, FIG. 3*b* illustrating a medicament pack as the container 14 containing blister packs 18, and FIG. 3*c* illustrating an inhaler 19 with a gas bottle on whose inner wall the aid's signal transmitter 1 is mounted. In the latter case, this signal transmitter may have a pressure or filling level sensor for detecting the state of the gas bottle filling.

In this context, the aid's signal transmitter 1 may be produced using polymer electronic circuitry, for example, and is preferably integrated directly in the medicament pack. The former aspect is particularly beneficial for medicaments' disposable packaging, since such circuits can be produced inexpensively and in a space-saving manner.

The invention claimed is:

1. A warning system for monitoring the availability of medical aids for a patient, comprising:

a first signal transceiver mounted on the aid or on a container for the aid or integrated in the aid or container and including a transmission unit for transmitting first electromagnetic signals, and a second signal transceiver worn by the patient comprising:

a warning device for outputting a warning signal perceivable by the patient, a receiving unit for receiving the first electromagnetic signals transmitted by the transmission unit in the first signal transceiver, and a control unit for actuating the warning device to output the warning signal upon receipt of the first electromagnetic signals from the first signal transceiver having a reception signal strength below a threshold value and a particular item of information associated with the medical aid is transmitted with the first electromagnetic signals.

2. The warning system as claimed in claim 1, wherein the first signal transceiver has a control unit for actuating the transmission unit.

3. The warning system as claimed in claim 2, wherein the first signal transceiver comprises one or more sensors connected to the control unit for detecting an operative state of the medical aid.

4. The warning system as claimed in claim 1, wherein the transmission unit in the first signal transceiver transmits the first electromagnetic signals at regular intervals of time.

5. The warning system as claimed in claim 3, wherein the second signal transceiver comprises a transmission unit for transmitting second electromagnetic signals, and the first signal transceiver comprises a reception unit connected to the control unit for receiving the second electromagnetic signals transmitted by the transmission unit in the second signal transceiver, wherein the first transceiver control unit actuates the first transceiver transmission unit to transmit a response signal when the second electromagnetic signals are received.

6. The warning system as claimed in claim 5, wherein the transmission unit in the second signal transceiver transmits the second electromagnetic signals at regular intervals of time.

7. The warning system as claimed in claim 6 wherein the control unit in the first signal transceiver transmits an item of information with the response signal, wherein the item of information represents a state of the aid detectable by a sensor.

8. The warning system as claimed in claim 7, wherein the control unit in the second signal transceiver actuates the warning device upon receiving a response signal which contains an item of information about an irregular or incorrect state of the aid.

9. The warning system as claimed in claim 3, wherein the control unit in the first signal transceiver, upon detection of an irregular or incorrect state of the aid, actuates the transmission unit in the first transceiver to transmit at least one of the first electromagnetic signals and an item of information transmitted with the first electromagnetic signals about the irregular or incorrect operative state of the aid.

10. The warning system as claimed in claim 9, wherein the control unit in each of the first and second signal transceivers comprises a time comparison device for prompting the output of a warning signal at least one of during and at a predetermined interval of rime before a time linked to the aid is reached.

11. The warning system as claimed in claim 10, wherein the second signal transceiver is miniaturized such that the second transceiver is worn by the patient in the form of a ring or other comparably small piece of jewelry.

12. The warning system as claimed in claim 11, wherein the first signal transceiver is miniaturized for packaging together with medicaments in a medicament pack.

13. The warning system as claimed in claim 12, wherein the second signal transceiver has a wireless interface for communicating with an external transmission device for transmitting a warning message to other people.

14. The warning system as claimed in claim 13, wherein the first signal transceiver is produced using polymer electronic circuitry.

15. A method for monitoring the availability of medical aids for a patient comprising the activities of:

transmitting first electromagnetic signals from a first signal transceiver mounted on the aid or on a container for the aid, or integrated in the aid or container, receiving the electromagnetic signals transmitted by the transmission unit in the first signal transceiver with a second signal transceiver carried by the patient, and outputting a warning signal which is perceivable by the patient upon receipt of the first electromagnetic signals having a signal reception strength below a threshold value and including a particular item of information associated with the medical aid transmitted with the first electromagnetic signals.

16. The method of claim 15, further including the activity of transmitting the first electromagnetic signals at regular intervals of time.

17. The method of claim 15, further including the activities of transmitting second electromagnetic signals by the second signal transceiver, receiving the second electromagnetic signals by the first signal transceiver, and transmitting a response signal by the first signal transceiver when second electromagnetic signals are received.

18. The method of claim 17, further including the activity of transmitting the second electromagnetic signals at regular intervals of time.

19. The method as claimed in claim 18, further including the activity of detecting a state of the aid using one or more sensors in the first signal transceiver.

20. The method of claim 19 further including the activity of incorporating an item of information concerning the state of the aid into the response signal.

21. The method of claim 20, further including the activity of outputting a warning signal with the second signal transceiver when a response signal signaling an irregular or incorrect state of the aid is received from the first signal transceiver.

22. The method of claim 19, further including the activity of transmitting first electromagnetic signals with an item of information about the irregular or incorrect state of the aid with the first electromagnetic signals upon detection of an irregular or incorrect state of the aid.

23. The method of claim 22, further including the activity of comparing a present time with a time linked to the aid, and outputting a warning signal with the second signal transceiver at a predetermined period before the time linked to the aid is reached.

24. The method of claim 23, further including the activity of is packaging the first signal transceiver together with medicaments in a medicament pack.

25. The method of claim 24, further including the activity of establishing a connection with the second signal transmitter via a wireless interface to an external reception device when a warning signal occurs and uses the external reception device to transmit a warning message to one or more other people.

* * * * *